US007705281B2

(12) United States Patent
Kawasaki et al.

(10) Patent No.: US 7,705,281 B2
(45) Date of Patent: Apr. 27, 2010

(54) IMAGE FORMING APPARATUS WITH IMPACT APPLYING UNIT AND DETECTING UNIT FOR DETECTING SHEET INFORMATION CORRESPONDING TO IMPACT FORCE

(75) Inventors: Takehiko Kawasaki, Atsugi (JP); Norio Kaneko, Atsugi (JP); Kimio Handa, Chchibu-gun (JP); Naoaki Maruyama, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 11/845,218

(22) Filed: Aug. 27, 2007

(65) Prior Publication Data

US 2008/0251997 A1 Oct. 16, 2008

Related U.S. Application Data

(62) Division of application No. 10/536,912, filed as application No. PCT/JP03/016932 on Dec. 26, 2003, now Pat. No. 7,304,291.

(30) Foreign Application Priority Data

Dec. 27, 2002 (JP) ..... 2002-382159

(51) Int. Cl.
*H01L 27/00* (2006.01)

(52) U.S. Cl. ..... 250/208.1; 250/221

(58) Field of Classification Search ..... 250/208.1, 250/221, 231.1; 347/227, 262–264
See application file for complete search history.

(56) References Cited

U.S. PATENT DOCUMENTS

| | | | | |
|---|---|---|---|---|
| 5,555,009 | A | 9/1996 | Hevenor et al. | 347/198 |
| 5,748,182 | A | 5/1998 | Ohashi et al. | 345/173 |
| 6,032,578 | A | 3/2000 | Nakamura | 101/129 |
| 6,291,829 | B1 | 9/2001 | Allen et al. | 250/559.07 |
| 6,734,417 | B2 * | 5/2004 | Vejtasa | 250/231.13 |
| 6,866,263 | B2 | 3/2005 | Kawasaki | 271/262 |
| 2002/0154205 | A1 | 10/2002 | Kaya | 347/177 |
| 2005/0040587 | A1 | 2/2005 | Kawasaki | 271/100 |
| 2005/0271403 | A1 | 12/2005 | Kaneko et al. | 399/44 |
| 2006/0016996 | A1 | 1/2006 | Kaneko et al. | 250/339.1 |
| 2006/0022400 | A1 | 2/2006 | Kawasaki et al. | 271/227 |

(Continued)

FOREIGN PATENT DOCUMENTS

DE 4025360 A1 2/1992

(Continued)

*Primary Examiner*—Que T Le
(74) *Attorney, Agent, or Firm*—Fitzpatrick, Cella, Harper & Scinto

(57) ABSTRACT

Disclosed is an information detecting device capable of reducing fluctuation in detection accuracy. A recording sheet P transported through a transport path comes into contact with a displacing member, and, in this state, a motor is driven to rotate a cam, and the resilient force of a coil spring causes a pressurizing member to collide with the recording sheet P. The impact force at that time is detected by a detection sensor, and transmitted to a sheet material information obtaining means. Then, on the basis of the detection result, it is possible to detect the type, density, thickness, surface irregularities, etc. of the recording sheet P. At this time, the recording sheet P is in contact with the displacing member, whereby it is possible to reduce fluctuation in detection accuracy due to positional deviation of the recording sheet P.

11 Claims, 7 Drawing Sheets

U.S. PATENT DOCUMENTS

2006/0054842 A1 3/2006 Kawasaki et al. ..... 250/559.04

FOREIGN PATENT DOCUMENTS

DE 10151627 A1 7/2002
JP 1-127543 5/1989
JP 5-238575 9/1993
JP 8-58166 3/1996
JP 8-324831 12/1996

* cited by examiner

SHEET MATERIAL : ST(GAAA1896)
MANUFACTURED
BY FUJI XEROX

IMAGE FORMING APPARATUS WITH IMPACT APPLYING UNIT AND DETECTING UNIT FOR DETECTING SHEET INFORMATION CORRESPONDING TO IMPACT FORCE

This application is a divisional of U.S. patent application Ser. No. 10/536,912, filed May 27, 2005.

TECHNICAL FIELD

The present invention relates to an information detecting device capable of obtaining information on sheet materials, a sheet material processing apparatus equipped with the information detecting device, and a signal output device.

BACKGROUND ART

Recently, attention has been focused on a sheet material information detecting devices adapted to obtain information on a sheet material to discern the kind of sheet material.

In U.S. Pat. No. 6,291,829, there is proposed a sheet material information detecting device mounted in an image forming apparatus, in which light is emitted toward a recording medium from a light source arranged along a recording medium path and in which the intensity of the radiation from the surface of the recording medium is detected by a sensor, thereby discerning the kinds of recording mediums.

However, due to the demand for a reduction in the size of image forming apparatuses, the recording medium path is curved in many cases. Further, the recording medium transporting speed has been increased. Thus, the sheet material, such as a recording medium, flutters as it is transported, so that its angle with respect to the light source and the sensor is not fixed, resulting in fluctuation in the accuracy in information detection.

DISCLOSURE OF THE INVENTION

It is accordingly an object of the present invention to provide a sheet material information detecting device which is satisfactory and uniform in information detection accuracy, and a sheet material processing device.

The present invention has been made in view of the above, and the information detecting device of the present invention is a sheet material information detecting device for detecting information on a sheet material, comprising:

a sheet material transport means for transporting a sheet material along a sheet material transport path;

force applying means for applying an external force to the sheet material;

external force detecting means for detecting information corresponding to a force existing after attenuation of the external force applied to the sheet material; and a positioning means for positioning the sheet material, wherein, when the force is to be applied, the positioning means performs positioning of the sheet material such that the distance between the sheet material and the detecting means opposed to the sheet material is a predetermined value not less than 0.

A sheet material processing apparatus according to the present invention comprises the sheet material information detecting device described above and a sheet material processing portion for performing the processing of a sheet material based on the detection result obtained by the sheet material information detecting device.

Further, a signal output device according to the present invention comprises an external force applying portion for applying an external force to a sheet material and a signal output portion for outputting a signal upon application of the external force, wherein a displacing member for controlling the position of the sheet material is provided at a position opposed to the external force applying portion with interposition of the sheet material therebetween.

Further, a method of obtaining information on a sheet material according to the present invention comprises the steps of:

supplying a sheet material to a position between force applying means for applying an external force to the sheet material and detecting means for detecting information corresponding to a force existing after attenuation of the external force applied to the sheet material;

positioning the sheet material such that the distance between the sheet material and the detecting means opposed to the sheet material is a predetermined value not less than 0;

applying an external force to the positioned sheet material; and detecting information on the sheet material.

BEST MODE FOR CARRYING OUT THE INVENTION

The embodiments of the present invention will now be described with reference to FIGS. 1 through 6.

Figure 1:
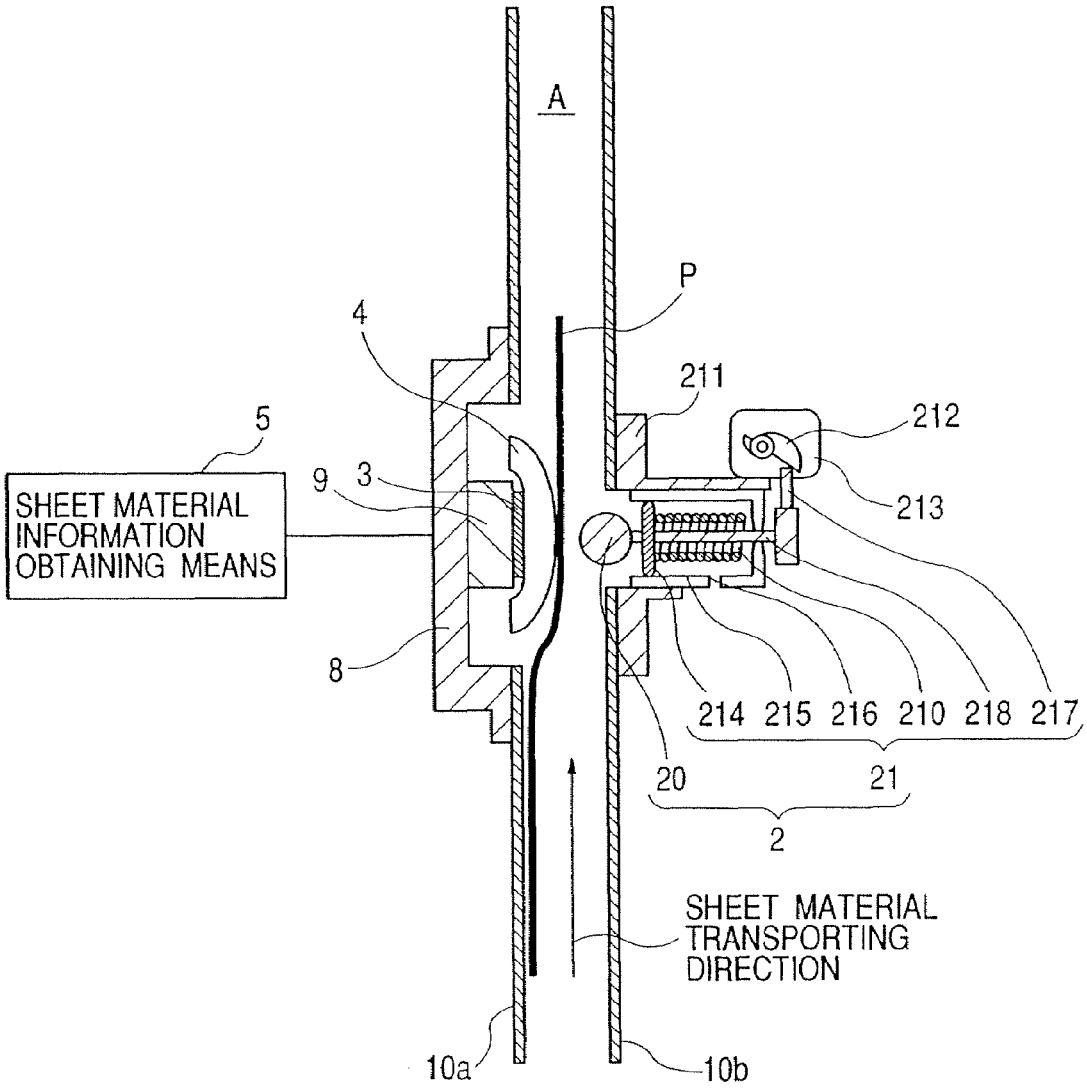
FIG. 1 is a sectional view showing an example of the construction of a sheet material information detecting device according to the present invention.
Figure 4:
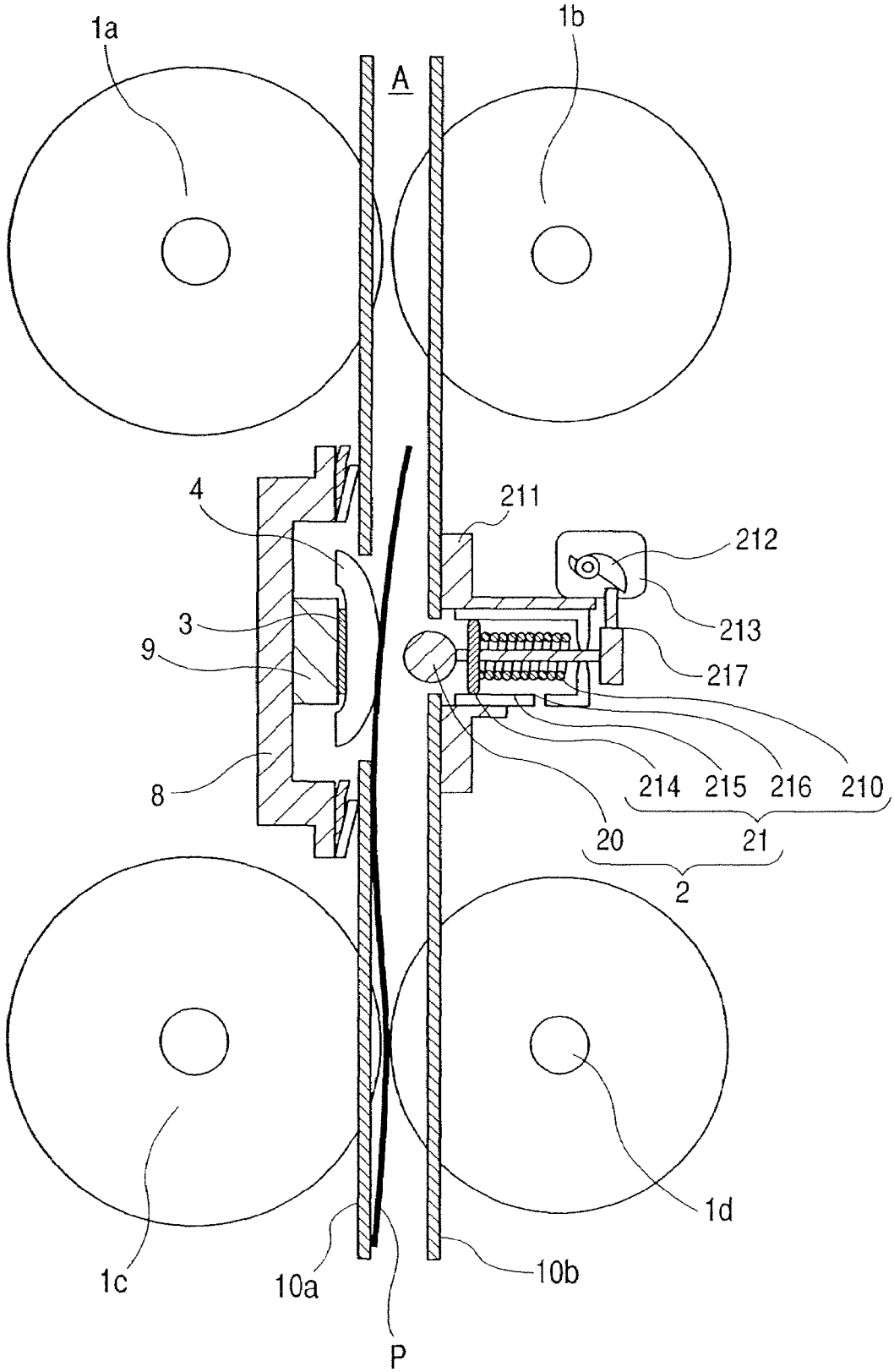
FIG. 4 is a sectional view showing a still further example of the construction of a sheet material information detecting device according to the present invention.

As shown in FIGS. 1 and 4, a sheet material information detecting device according to this embodiment is equipped with sheet material transporting means (indicated by reference symbols 1*a*, 1*b*, 1*c*, and 1*d* in FIG. 4) for transporting a sheet material P along a sheet material transport path A, an external force applying means 2 for applying a physical force (hereinafter also referred to as "external force") to the sheet material P transported, and an external force detecting means 3 for detecting information corresponding to a force existing after attenuation of the external force applied to the sheet material P, and is structured such that information on the sheet material P is obtained on the basis of the detection result of the external force detecting means 3. The external force applying means 2 may be arranged in a narrowed portion provided in the sheet material transport path A.

Figure 2:
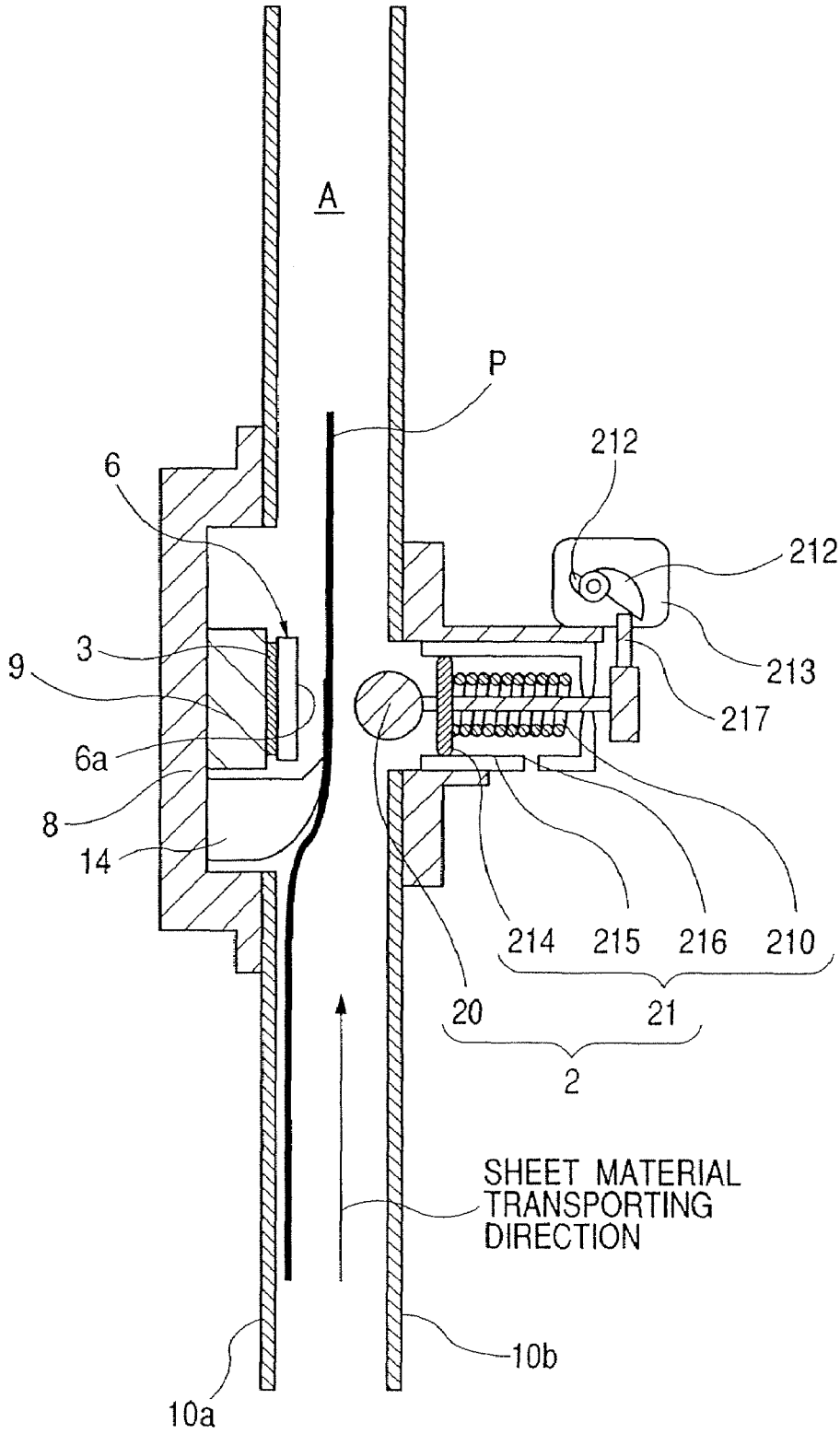
FIG. 2 is a sectional view showing another example of the construction of a sheet material information detecting device according to the present invention.

As shown in FIGS. 1 and 2, the sheet material information detecting device of this embodiment is equipped with a sheet material displacing means 4, 14 for displacing the sheet material P, which is transported along the sheet material transport path, to an appropriate position, and the application of the external force by the external force applying means 2 is effected on the sheet material P displaced by the sheet material displacing means 4, 14.

Incidentally, the information on the sheet material may be obtained, through human judgment based on a signal detected by the external force detecting means 3, or by providing a sheet material information obtaining means (indicated by reference numeral 5 in FIG. 1) to automatically obtain sheet material information based on the detection result obtained by the external force detecting means 3. The information on the sheet material can be output after being extracted from the waveform of the detected signal as a characterization amount, such as voltage, period, frequency component, differential value, integral value, attenuation, or peak number. Further, by checking such characterization amount against a table previously storing sheet material signals, the sheet material information obtaining means 5 may output judged information regarding the kind or model of sheet material, change in state, printing state, double feeding, etc. When the sheet material signal differs according to the environmental conditions, the transporting state, etc., by preparing a plurality of tables respectively corresponding to the different factors, a judgment may be made based on these tables. Further, it is also possible to make a judgment on the sheet material in combination with other means (e.g., the input of an intentionally set sheet model or a signal from a artificially provided sensor).

The detected signal may be subjected a signal processing, such as subtraction of the output signal when no sheet material is being transported. The processing circuit for such signal processing can perform signal processing by using a first signal outputted from the external force detecting means which received the external force when the sheet material is not sandwiched, and a second signal outputted from the sensor portion which received the external force when the sheet material is sandwiched.

In the present specification, the term "sheet material" refers to a recording medium (e.g., plain paper, calendared paper, coated paper, recycled paper, or OHP), an original or the like.

The expression "information on a sheet material" refers to the type of the sheet material, the density of the sheet material, the thickness of the sheet material, the surface irregularities of the sheet material, variation in the state of the sheet material, the printing state, the presence or absence of double feeding of the sheet materials, the number of sheets double-fed, the number of residual sheets, the presence or absence of the sheet material, the superimposing position of sheet materials, etc.

Figure 5:
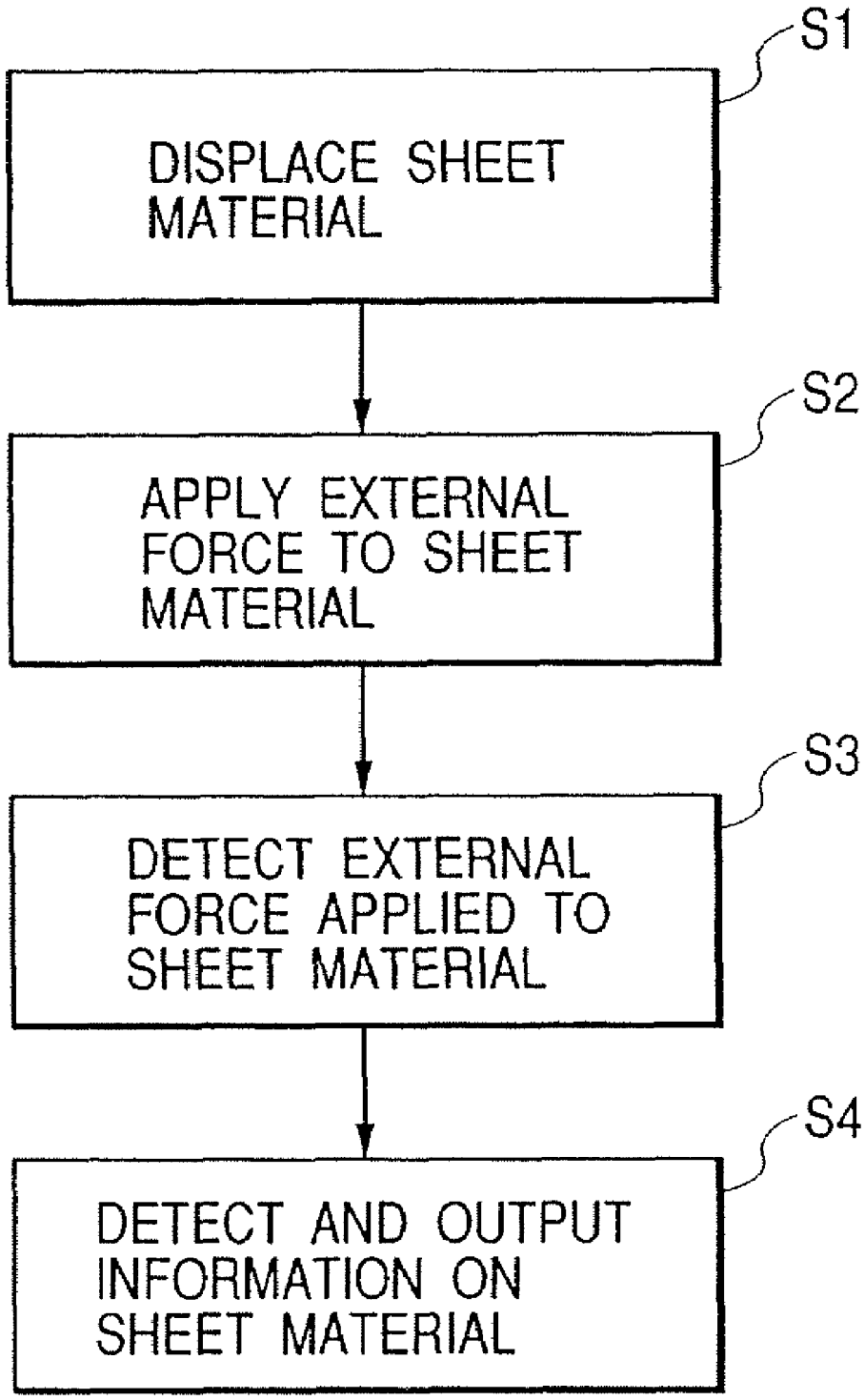
FIG. 5 is a flowchart for illustrating the operation of a sheet material information detecting device according to the present invention.

In the sheet material information detecting device described above, the sheet material transporting means 1*a*, 1*b*, 1*c* and 1*d* transport the sheet material P, the sheet material displacing means 4 or 14 displaces the transported sheet material P to perform positional adjustment (step S1 in FIG. 5), the external force applying means 2 applies an external force to the sheet material P in this state (step S2 in FIG. 5), the external force detecting means 3 detects the external force (step S3 in FIG. 5), and information on the sheet material can be obtained based on the detection result (e.g., an electric signal) (step S4 in FIG. 5).

The external force applying means 2 described above may be one equipped with an external force applying member (indicated by reference numeral 20 in FIG. 1) adapted to apply an external force to the sheet material by coming into contact with the sheet material, or one adapted to blow a gas, such as air, against the sheet material. The external force applying member 20 may be driven by a drive source (indicated by reference numeral 21 in FIG. 1). The external force to be used in the present invention may utilize any type of energy, including electromagnetism, heat, expansion/contraction of a medium such as gas by heat, light like laser beam, electromagnetic wave, sound wave, vibration, and dynamic force. Examples of the drive source include one which retains the external force applying member 20 above the sheet material P, and appropriately causing the member 20 to fall on the sheet material P, one adapted to drive the external force applying member 20 by mechanical or electromagnetic energy (e.g., a mechanical means like a spring, or an electromagnetic means like a solenoid or a voice coil), and an excitation means for vibrating the external force applying member 20 (e.g., piezoelectric actuator, electrostatic actuator, or electromagnetic acoustic generator). The drive source indicated by reference numeral 21 in FIG. 1, etc. utilize the resilient force of a spring 210.

For example, an impact force is applied to the sheet material P by the above-described external force applying member 20. Examples of the method of doing so include a method in which the external force applying member 20 is caused to collide with the sheet material P from a position spaced away therefrom, and a method in which an impact force is applied to the sheet material P from the external force applying member 20, with the external force applying member 20 being held in contact with the sheet material P. That is, although the external force is applied by the external force applying member 20 in a state of the member 20 in contact with the sheet material P, the external force applying member 20 may be brought into contact with the sheet material P only when the external force is to be applied thereto, or the external force applying member 20 may be brought into contact with the sheet material P prior to the application of the external force and kept in contact therewith. When, in the former case, the external force applying means and the external force detecting means are opposed to each other with interposition of the sheet material therebetween, the distance between the external force applying means and the external force detecting means is changed (shortened) during application of the external force. Further, depending upon the degree of strength of the force, when the force is applied to the sheet material by the external force applying means, the sheet material can be slightly deformed (e.g., dented), and therefore that the external force may be applied to an end or the like of the sheet material. In the latter case (in the case in which the external force applying member 20 is brought into contact with the sheet material P prior to the application of the external force), the external force is applied with the external force applying member 20 and the external force detecting means being in contact with the sheet material.

Instead of an impact force, it is also possible to apply vibration to the sheet material P by bringing the external force applying member 20 while kept vibrating into contact with the sheet material P.

Incidentally, the application of the external force may be effected in the state in which the sheet material P is being transported or in the state in which the sheet material P transported is temporarily stopped. In the case in which the external force is applied to the sheet material being transported, it is easy to detect the state of the surface (the external force application means side) of the sheet material. In the case in which the external force is applied to the sheet material P at rest, it is also possible to reduce the noise component resulting from the movement of the sheet material. Such transporting state is suitably designed and controlled according to the information required.

While, as stated above, a plurality of kinds of external force are available, it is possible to use only one kind of external force, or a plurality of kinds of external force. In the case in which one kind of external force is used, the obtaining of information on the sheet material may be effected by applying the external force once, or by applying the external force a plurality of times. In the case in which the application of the external force is effected a plurality of times (that is, in the case in which one kind of external force is applied a plurality of times or in the case in which a plurality of kinds of external force are applied), it is possible to obtain a plurality of items of data, so that it is possible to achieve an improvement in discerning accuracy. When applying the external force a plurality of times, it is possible to intermittently apply impact forces or vibrations of different degrees of intensity from a single external force applying member, or to apply impact forces or vibrations of different degrees of intensity from a plurality of external force applying members. In the case in which the application of the external force is thus effected a plurality of times, it is desirable to apply a next external force after the oscillation of the sheet material due to an external force once applied has been attenuated to a sufficient degree or after it has become lower than a predetermined value.

Incidentally, to effect the information detection with high accuracy, it is necessary to always apply a fixed external force to the sheet material P. In view of this, it is also desirable to arrange a member (hereinafter referred to as "external force receiving member") at a position opposed to the external force applying member 20, causing that member to receive the external force. When a displacing member (described in detail below) is arranged so as to be opposed to the external force applying member 20, the displacing member may serve to function as the external force receiving member (that is, the external force may be received by this displacing member without separately providing any external force receiving member). When the displacing member is arranged at a position that is not opposed to the external force applying member 20, the external force receiving member (indicated by reference numeral 6 in FIG. 2) is provided at a position opposed to the external force applying member 20. The surface of the external force receiving member coming into contact with the sheet material may be a flat surface or a curved surface. Further, it is also desirable, from the viewpoint of device service life, etc., to provide on the surface of the external force receiving member a recess at, for example, a position opposed to the forward end of the external force applying member 1 with interposition of the sheet material therebetween to thereby prevent concentration of the external force at a single point.

On the other hand, the above-mentioned external force detecting means serves to detect information according to the force received after the attenuation of the external force applied to the sheet material. This detecting means may be formed of an inorganic or organic material having piezoelectric property, for example, an inorganic material, such as PZT (lead zirconate titanate), PLZT, BaTiO3, or PMN-PT (Pb(Mg⅓Nb⅔)O3-PbTiO3), or an organic piezoelectric material. When a piezoelectric element is used, the external force is detected as a voltage signal. Here, the external force detecting means includes the detection element which is exposed or covered.

This external force detecting means 3 may be arranged at any position as long as it can detect the external force. For example, the external force detecting means may be provided at a position opposed to the external force applying means 2 with interposition of the sheet material P therebetween, or the external force detecting means may be provided on a side of the external force applying means 2. FIGS. 1 through 4 show the former case (that is, the case in which the external force detecting means 3 is arranged at a position opposed to the external force applying means 2 through the sheet material P). The external force detecting means 3 shown in the drawings supports a displacing member 4 serving as the external force receiving member or an external force receiving member 6, so that the external force detecting means 3 detects the external force received by the member 4, 6. In such arrangement, it is possible to efficiently detect the absorption of the sheet material with respect to the external force applied. Examples of the arrangement in the latter case (that is, in the case in which the external force detecting means is provided on a side of the external force applying means 2) include one in which an elastic member like a plate spring (not shown) is mounted to the external force applying means to detect vibration or displacement of the elastic member at the time of application of the external force, and one in which the external force detecting means is mounted on the external force applying means itself. In such arrangement, it is possible to efficiently detect the repulsion of the sheet material with respect to the external force applied. The external force detecting means also may be arranged both on the side opposed to the external force applying means 2 and on the side of the external force applying means 2, with the sheet material P sandwiched therebetween. Further, for example, when the external force detecting means is mounted on the external force applying means, a change in the external force applying means itself (e.g., resonance frequency or deformation) may be detected at the time of contacting with the sheet material. Further, it is also possible to detect the reverberation remaining after the stopping of the external force applied, its attenuation property, etc.

The external force detecting means may be arranged one-dimensionally or two-dimensionally. When, in the latter case, there is provided a sensor portion having a length that is the same as or larger than the width of the sheet material (e.g., the recording medium), it is also possible to detect the width of the sheet material. Of course, it is also possible to detect the width of the recording medium by a plurality of sensor portions.

The external force detecting means may be one-dimensionally or two-dimensionally arranged. When, in the latter case, there is provided a sensor portion having a length that is the same as or larger than the width of the sheet material (e.g., the recording medium), it is also possible to detect the width of the sheet material. Of course, it is also possible to detect the width of the recording medium by a plurality of sensor portions.

The positioning means (hereinafter referred to as "sheet material displacing means") used in the present invention may have any construction as long as it is capable of displacing the sheet material. For example, it may be one which displaces the sheet material through a cushioning layer consisting of air or the like, or one equipped with a displacing member 4, 14 protruding into the sheet material transport path (that is, provided so as to protrude between sheet transport guides of the sheet transport path) in which the sheet material P is displaced by bringing the displacing member 4, 14 into contact with the sheet material. Further, it is important that positioning be effected on the sheet material such that the distance between the sheet material and the detecting means is a predetermined value not less than 0.

By this sheet material displacing means, it is possible to determine the position of the sheet material with respect to the external force detecting means 3 (that is, the distance between the sheet material P and the external force detecting means 3), to determine the position of the sheet material with respect to the external force applying means 20 (that is, the distance between the sheet material P and the external force applying means 20), or to determine the position of the sheet material with respect to the external force receiving member 6 (that is, the distance between the sheet material P and the external force receiving member 6). In the case in which the position of the sheet material with respect to the external force receiving member 6 is determined, it is possible to fix the amount of deflection of the sheet material due to the application of the external force and to fix the amount of external force to be absorbed thereby, so that it is possible to perform detection in a stable manner with respect to the external force applied. More preferably, the sheet material P is brought into contact with the external force receiving member by the sheet material displacing means. For such control, an arrangement is adopted in which the external force receiving member is pressed against the sheet material to be transported. Alternatively, it is also possible to cause displacement by the sheet material displacing means so as to press the sheet material against the external force receiving member.

Incidentally, in the case in which the displacing member 4, 14 protrudes into the sheet material transport path as described above, it is only necessary to displace the sheet material restricted within a fixed range for its direction by the sheet transport guides, so that it is possible to perform a more stable control with a small mechanism. Further, from the viewpoint of preventing jamming, etc. of the sheet material, the amount by which the displacing member 4, 14 protrudes into the sheet transport path is desirably not less than 1/10 and not more than 1/2 of the width of the transport path (the width of the transport path at the portion where the displacing member 4, 14 is arranged).

The displacing member 4, 14 may be arranged such that its protruding amount is fixed within the above-mentioned range, such that its protruding amount can be adjusted, or such that the displacing member can freely move when no external force is applied so as to avoid interference with the sheet material P. When the displacing member is constructed so as to be freely movable, it is possible to reduce the occurrence of problems, such as jamming, and to mitigate a deterioration due to wear of the displacing member.

The arrangement position for this displacing member is determined taking into consideration the sheet material installing position, transporting direction, etc. The displacing member is arranged at a position such that the advancing direction of transporting the sheet material is changed so as to bring it to a position favorable for the external force application. Further, in a case in which the sheet material advances while fluttering within the transporting system, an arrangement is adopted which helps to restrain the fluttering such that the portion of the sheet material to which the external force is applied is kept locally/temporarily within a predetermined positional range upon application of the external force. It is possible to provide only one such displacing member or to use a combination of a plurality of such members. Here, the term "displacement" refers to displacement in any of all the three dimensions including the thickness direction and the in-plane direction of the sheet material.

The manner of displacement may be an arbitrary one, e.g., change of direction by a member (displacing member) arranged in the advancing path for the sheet material, or pressing of the sheet material. The displacement may be effected from only one side of the sheet material or from both sides thereof.

Examples of the displacing member used in the present invention include a plate member, a spherical member, a roller, and a plate spring. Usually, the sheet material is transported while "fluttering", so that it is desirable for the displacing member to be of a configuration enabling it to avoid the influence of the "fluttering" and to displace the sheet material in a stable manner. For example, it is a so-called barrel-roof-shaped member whose portion coming into contact with the sheet material has an arcuate section at least on the upstream side with respect to the sheet material transport. Further, it is desirable to deform a part of the transport guides for the sheet material so as to make it convex on the transport path side, thereby providing a displacing member.

Incidentally, it is preferable for the portion of the displacing member coming into contact with the sheet material to be resistant to wear. More specifically, it is desirable to use a material with small coefficient of friction or a material superior in wear resistance or to mirror-finish the material surface. This makes it possible to reduce the change with elapse of time of the displacing amount of the sheet material, and to maintain a satisfactory level of accuracy in the detection of sheet material information. In particular, in the case in which the material surface is mirror-finished, it is possible to mitigate the influence of the vibration on the detection signal. Of course, the displacing member may also serve as the transport roller. However, in view of the noise due to the driving by the motor, etc., it is desirable for them to be separate components.

In the case in which the displacing member is used, it is necessary for the member to be in contact with the sheet material P. For that purpose, it is preferable to provide, as indicated by reference numeral 7 in FIG. 3, an auxiliary displacing member on the side opposed to the displacing member 4 (the side of arranging the external force applying means 2) through the sheet material P, forcibly bringing the sheet material P into contact with the displacing member 4. In particular, when the displacing member also serves as the external force receiving member, this construction is preferable from the viewpoint of stable application of the external force.

Further, it is also desirable to provide the above-described sheet material displacing means with a sheet material sensor for detecting the state and position of the sheet material P (the mutual action between the sheet material displacing means and the sheet material). Here, the expression "state and position of the sheet material P (the mutual action between the sheet material displacing means and the sheet material)" refers to the condition in which the sheet material displacing means is held in contact with the sheet material, the position of the leading edge of the sheet material, the passing state of the sheet material, the pressure of the sheet material displacing means received from the sheet material, deformation of the sheet material, etc. Examples of the sheet material sensor include a mechanical sensor adapted to detect contact, deformation, etc., an optical sensor, a pressure sensor for detecting pressure, and an acceleration sensor for detecting vibration. Such sheet material sensor may be directly bonded to the sheet material displacing means, or installed in the vicinity of the sheet material displacing means, and can be suitably designed according to the type of sensor to be used.

By feeding back a signal from this sheet material sensor, it is possible to optimize the displacing amount of the sheet material displacing means, making it possible to detect sheet information with higher accuracy. Further, it is also possible to determine conditions, such as the starting/terminating timing, the intensity, etc. of the external force application, using a signal from this sheet material sensor as a reference. Further, by detecting the mutual action between the sheet material displacing means and the sheet material (pressure from the sheet material, deformation of the sheet material, etc.), it is possible to obtain more information on the sheet material by using it in combination with the signal due to external force application in the present invention.

Figure 6:
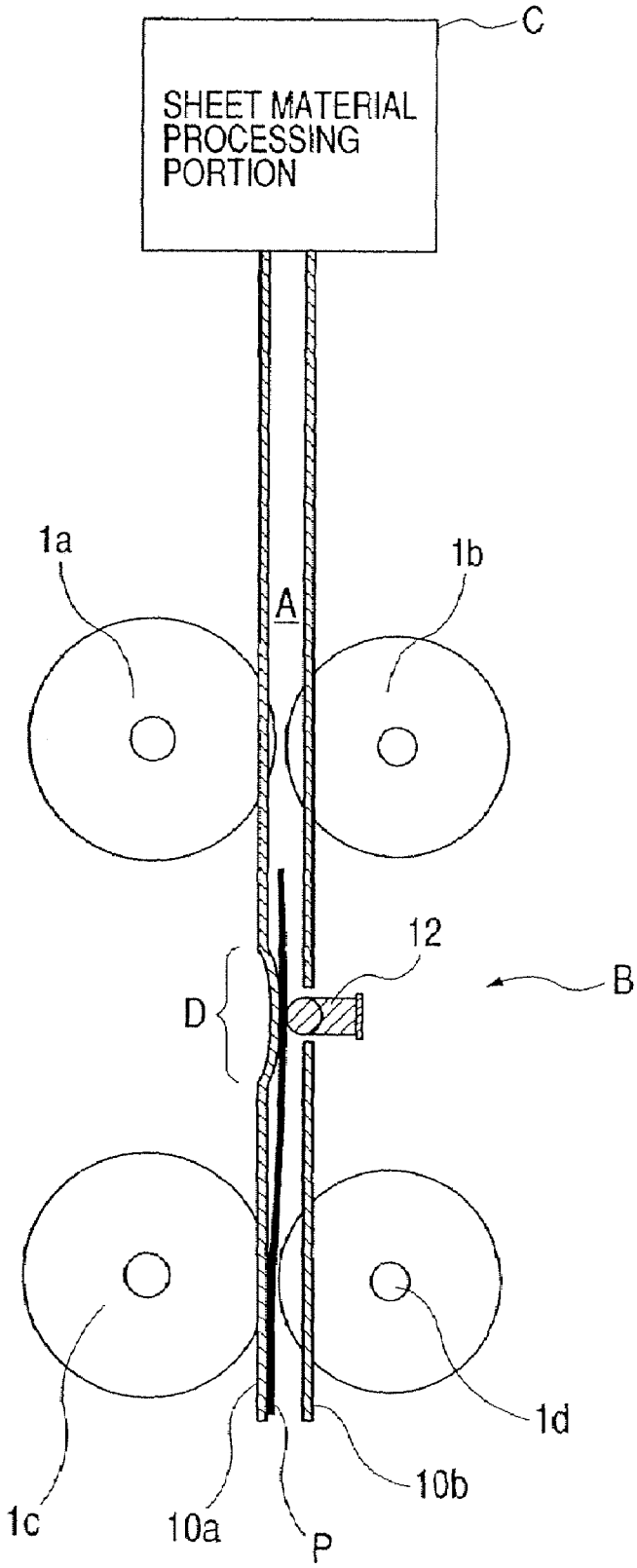
FIG. 6 is a schematic diagram showing an example of the construction of a sheet material processing apparatus according to the present invention.

Incidentally, as shown in FIG. 6, the sheet material processing apparatus of the present invention is composed of a sheet material information detecting device (indicated by symbol B) and a sheet material processing portion C for processing the sheet material P based on the detection result obtained by the sheet material information detecting device.

Here, the sheet material processing portion C may consist of an image forming portion for forming images, a scanner portion for reading images, or other devices. And the sheet material processing apparatus can include a copying machine, a printer, a facsimile machine, an image reading scanner, or an automatic original feeder.

Reference numeral 12 indicates an external force applying means, which may have a construction as shown in FIGS. 1 through 4.

Further, symbol D in FIG. 6 indicates a narrowed portion formed by swelling a sheet transport guide. By forming such a narrowed portion, it is possible to provide the function of a sheet material displacing means and an external force receiving member to the sheet transport guide.

And, on the basis of the detection result obtained by the sheet material information detecting device B, a CPU preferably effects variation in printing mode (e.g., adjustment of the image forming condition, adjustment of the transporting condition, such as the pressurizing force applied to the rollers for transporting, printing stop, stopping of the transporting of the recording medium, and generation of an alarm signal). Here, the CPU may be provided inside or outside the sheet material processing apparatus. When the CPU is provided inside, it is possible to omit transmission and reception of data signals to and from the exterior.

Incidentally, it is preferable that a signal output device comprises an external force applying portion for applying an external force to the sheet material P, a displacing member arranged at a position opposed to the external force applying portion (through the sheet material) and adapted to control the position of the sheet material P, and a signal output portion for outputting a signal due to the external force. In such a signal output device, it is preferable to connect an external apparatus to the signal output device, the external apparatus obtaining information on the sheet material based on an output signal from the signal output portion.

Next, the effect of this embodiment will be described.

Although the sheet material P flutters as it is transported through the sheet material transport path A by the sheet material transporting means 1*a*, 1*b*, 1*c*, and 1*d*, when the external force is detected by the external force detecting means 3, the sheet material P is retained at the proper position by the sheet material displacing means 4, 14, so that the fluttering is mitigated. Thus, an information detection accuracy becomes satisfactory and uniform.

In the following, the present invention will be described in more detail with reference to the following Examples.

EXAMPLE 1

In this example, a paper kind detecting device (sheet material information detecting device) of the construction as shown in FIG. 1 was prepared, and mounted in an electrophotographic apparatus (sheet material processing apparatus).

In the device, the sheet transport path A was formed by a pair of transport guides 10*a* and 10*b*, and a not shown transport roller (sheet material transport means) for transporting the recording sheet (sheet material) P was arranged in the sheet material transport path A. A cutout portion was provided in a part of the left-hand side transport guide 10*a*, and a bracket 8 was arranged so as to cover that portion, with a cushioning material 9, a detection sensor (external force detecting means) 3, and a displacing member 4 being mounted to the bracket 8 as shown in FIG. 1. That is, the cushioning material 9 supported the detection sensor 3, and the sensor 3 supported the displacing member 4, with the displacing member 4 protruding into the transport path. The amount by which the displacing member 4 protrudes was ¼ of the width of the transport path A (the width of the portion where the displacing member 4 was arranged), and, in the device of this example, it was so arranged that, no matter what kind of recording sheet (paper or OHP sheet) might be transported, it could come into contact with the displacing member 4. Further, this displacing member 4 was formed of a so-called barrel-roof-shaped metal member as shown in FIG. 1, and, at the upstream end and the downstream end with respect to the sheet transport direction, the surface of the displacing member coming into contact with the recording sheet P was formed so as to retract from the opening plane of the cutout portion of the left-hand side transport guide 10*a* facing the transport path A, and the central portion of the member was formed so as to protrude toward the right-hand side transport guide 10*b*.

The detection sensor 3 had a construction in which the PZT (lead zirconate titanate) as a piezoelectric member was sandwiched between upper and lower silver electrodes. The piezoelectric member had a length of 20 mm, a width of 5 mm, and a thickness of 0.3 mm. Further, the cushioning material 9, which consists of a rubber material, is arranged between the transport guide 10*a* and the detection sensor 3, whereby it is possible to mitigate propagation of mechanical vibration from the transport guide 10*a* to the detection sensor 3, and thereby to improve the detection accuracy. Incidentally, while in FIG. 1 the bracket 8 is fixed to the transport guide 10*a*, of course, there is not limited to this. As long as an appropriate level of rigidity and accuracy in fixation can be achieved, it is also possible to mount the bracket 211 on the side of the transport guide 10*b*, or integrate the brackets 8 and 211 and mount the integral unit to the transport guide 10*b*, or to mount the bracket to a portion other than the transport guides 10*a* and 10*b* (e.g., the casing or the frame).

On the other hand, at a position opposed to the displacing member 4, there was arranged an external force applying means 2 for applying an external force to the recording sheet P. That is, a cutout portion was provided in the right-hand side transport guide 10*b*, and the bracket 211 was arranged in the portion. A substantially cylindrical guide member 215 was mounted to the bracket 211, and a rod 218 was arranged in the guide member 215 so as to be freely movable in a horizontal direction, with a pressurizing member (an external force applying member) 20 being mounted to the forward end (the recording sheet side end) of the rod 218. The rod 218 was provided with a flange-like stopper member 214, and a coil spring 210 was provided in a compressed state between the stopper member 214 and the guide member 215. On the other hand, a motor 213 was mounted to the bracket 211, and a cam 212 was mounted to the output shaft thereof, with the cam 212 being capable of interfering with the protrusion 217 mounted to the end of the rod 218. Reference numeral 216 indicates a pressure release hole for mitigating damping due to the air in the guide member.

The coil spring 210 and the cam 212 cause the above-described pressurizing member 20 to collide with the recording sheet P at a predetermined speed to apply an external force thereto. For example, when the pressurizing member 20 is in a non-constrained state, the magnitude of the external force at that time is determined by the product "mv" of the mass m of the pressurizing member 20 and the colliding speed v, and the mutual action between the pressurizing member 20, the recording sheet P, and the external force receiving member. In the case, for example, where the type of plain paper sheet or the like is to be discerned, the magnitude of the external force is preferably in a range of approximately 0.1 gm/s to 10 gm/s. Further, the application of this external force is effected a plurality of times upon one signal output, with the value of the eternal force preferably varying. This makes it possible to detect information on the recording sheet with higher accuracy.

In this example, the cam 212 is stepped in two stages, and, with one rotation of the motor 213, it is possible to apply the external force twice in different magnitudes. That is, the larger cam 212 interferes with the protrusion 217 to cause the pressurizing member 20 to move to the right, and, the instant the lock of the cam 212 is released, the pressurizing member 20 is caused to collide with the recording sheet P by the resilient force of the coil spring 210; and the smaller cam 212 interferes with the protrusion 217 to cause the pressurizing member 20 to move to the right, and, the instant the lock of the cam 212 is released, the pressurizing member 20 is caused to collide with the recording sheet P by the resilient force of the coil spring 210. In this case, the distance by which the coil spring 210 is contracted differs between the larger cam 212 and the smaller cam 212, so that the external force applied to the recording sheet P differs.

Further, it is also desirable to provide another cam to the drive shaft of the cam 212 (i.e., the rotation shaft of the motor), and to cause the displacing member and the auxiliary displacing member to be displaced in linkage with the application of the external force.

In this example, the displacing member 4, which is arranged at a position opposed to the pressurizing member 20, receives the external force.

Next, the operation of this example will be described.

Figure 7:
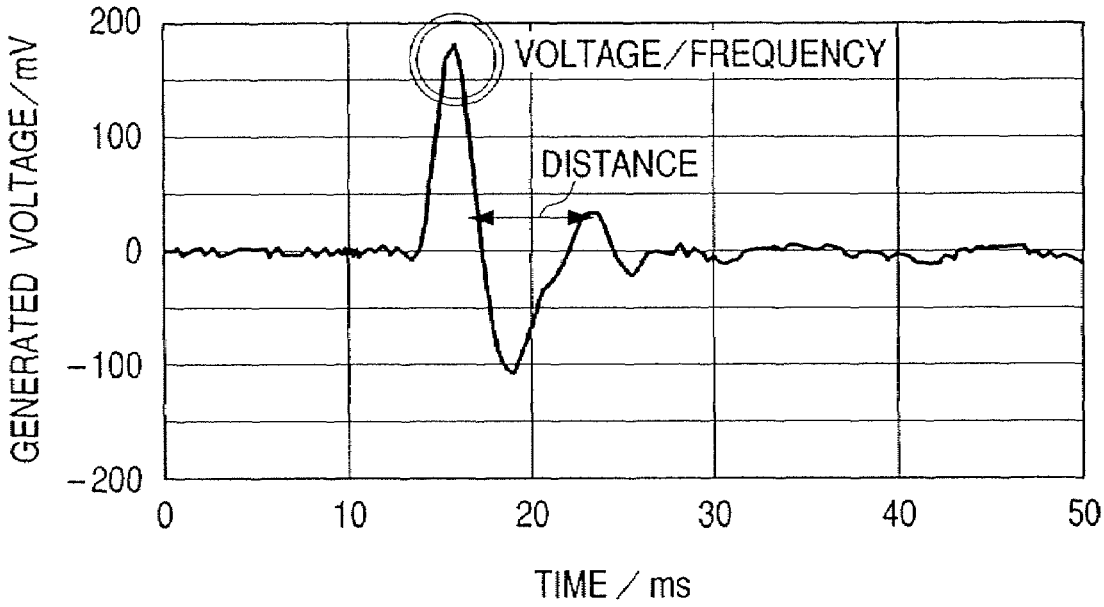
FIG. 7 is a waveform chart showing an example of a detection signal of an external force detecting means.

When the recording sheet P is transported by the transport roller, the pressurizing member 20 moves to the recording sheet P to apply an external force to the sheet. The external force at that time is transmitted to the detection sensor 3 through the displacing member 4, and a signal as shown in FIG. 7 is output. The signal in this case is one generated when a plain paper sheet (ST(GAAA1896) manufactured by Fuji Xerox) is detected. From the peak voltage value of the signal, the interval of a plurality of peaks thereof, the attenuation between the plurality of peaks, and frequency analysis of the waveform thereof, it is possible to extract information on the recording sheet P, such as the surface irregularities, friction, and thickness distribution thereof.

Next, the effect of this example will be described.

The recording sheet P is transported while undergoing deformation due to various factors in the transport path (stress from the roller, curve in the transport path, interference with the transport guides, change in an environmental factor such as heat, etc.). In this example, the detection of the external force is effected with the recording sheet P being held in contact with the displacing member 4. Thus, it is possible to mitigate the deformation, fluttering, etc. of the recording sheet P in the transport path, thereby making it possible to achieve a detection accuracy that is satisfactory and uniform.

Further, in the construction of this example, in which the displacing member 4 receives the external force, that is, in the construction in which the displacing member also serves as the external force receiving member, it is possible to reduce the portion coming into contact with the recording sheet, and to reduce the interference with the sheet transport, whereby it is possible to reduce transport defects (such as jamming), thereby realizing a stable operation.

EXAMPLE 2

Figure 3:
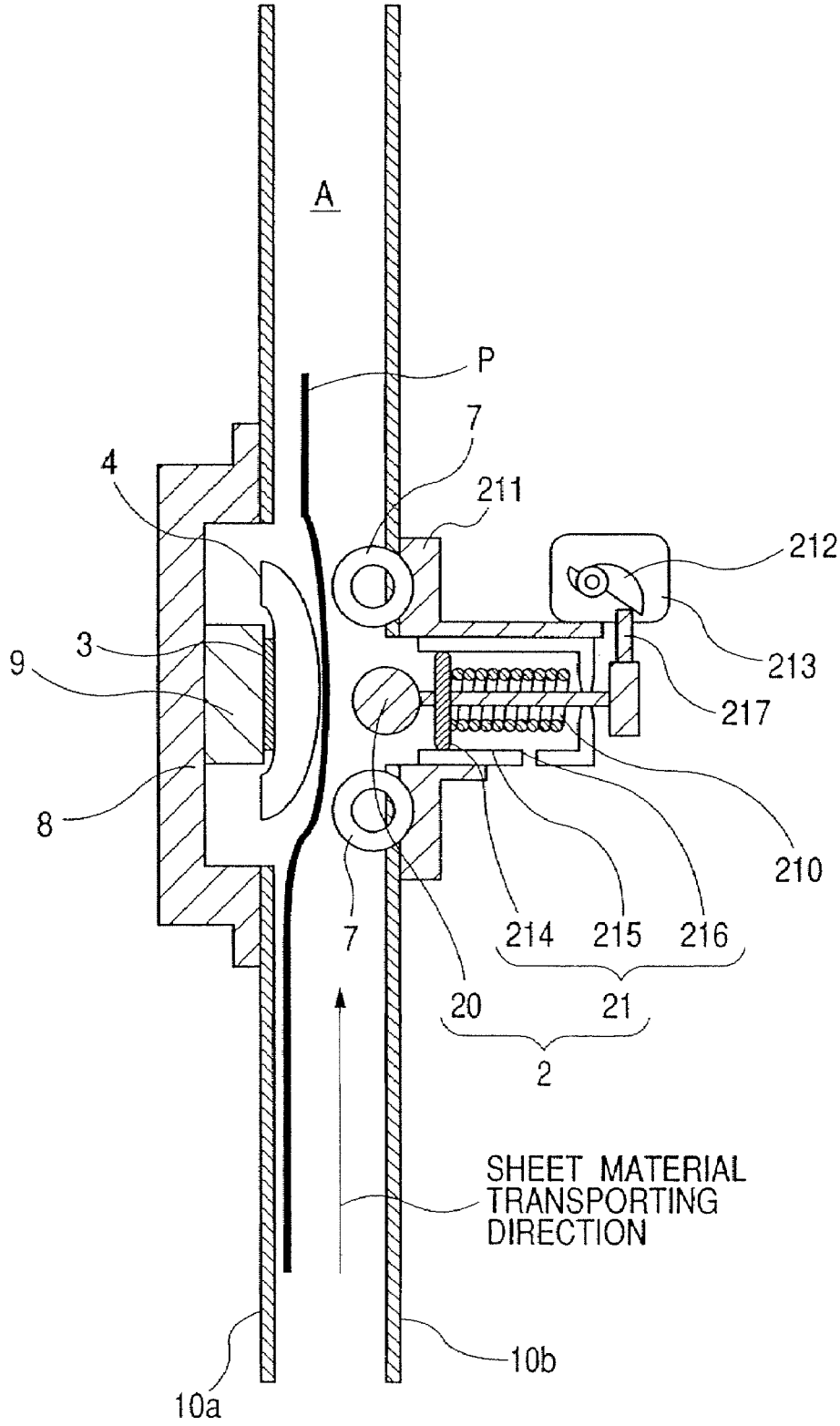
FIG. 3 is a sectional view showing a further example of the construction of a sheet material information detecting device according to the present invention.

In this example, a paper kind detecting device (sheet information detecting device) of the construction as shown in FIG. 3 was prepared, and mounted in an electrophotographic apparatus (sheet material processing apparatus). That is, resin rollers (auxiliary displacing members) 7 are arranged on the side of the transport guide **10*b* so as to be opposed to the end portions of the displacing member 4 (the upstream and downstream ends with respect to the sheet transport direction) through the recording sheet P. With this arrangement, the recording sheet P must pass the narrowed portion between the displacing member 4 and the resin rollers 7, whereby the recording sheet P comes into contact with the displacing member 4. These resin rollers 7 are formed so as to rotate when the recording sheet P transported comes into contact with them, so that they do not hinder the transport of the sheet P. Further, these resin rollers 7** are provided with a movement mechanism (not shown) allowing them to retract from the recording sheet P when they are not needed for external force application. Otherwise, the other constitution of this example is the same as that of Example 1.

By further stabilizing the contact direction (angle) of the recording sheet P with respect to the pressurizing member 20 and the displacing member 4 as compared with Example 1, it is possible to achieve a high detection accuracy.

EXAMPLE 3

In this example, a paper kind detecting device (sheet information detecting device) of the construction as shown in FIG. 2 was prepared and mounted in an electrophotographic apparatus (sheet material processing apparatus). That is, the displacing member is not opposed to the external force applying means 2 but arranged on the upstream side thereof (the upstream side with respect to the sheet transporting direction) (as indicated by reference numeral 14), and, at the position of the displacing member 4 in Examples 1 and 2, there is arranged an external force receiving member 6. An external force receiving surface **6*a* of the external force receiving member 6 is adapted to retract further from the recording sheet P than the tip of the displacing member 14** by 0.1 mm. Otherwise, the other constitution of this example is the same as that of Example 1.

In this example, it is possible to obtain the same effect as that of Example 1. Further, since the external force receiving surface **6*a* is at a position more recessed than the tip portion of the displacing member 14, the recording sheet P does not easily come into contact with the external force receiving surface 6*a* when no external force is being applied by the external force applying means 2, so that the detection sensor 3** does not easily detect noise. As a result, it is possible to achieve an improvement in detection accuracy.

It is also possible to previously read the signal of the detection sensor 3 when no recording sheet P is being transported, and to perform paper kind detection based on that signal corresponding to the initial state.

The invention claimed is:

1. An image forming apparatus, comprising:

an information detecting device for detecting information on a sheet material;

an image forming means for forming an image on the sheet material and which functions as a sheet material treating unit; and a sheet transport means for transporting the sheet material from the information detecting device to the image forming unit, wherein the information detecting device comprises:

means for applying an external force to the sheet material;

a detecting unit for detecting information corresponding to a force existing after attenuation of the external force applied to the sheet material, the detecting unit including a piezoelectric member; and a sheet material displacing means for displacing the transported sheet material to a proper position;

wherein, when the external force is to be applied, the sheet material displacing means performs positioning of the sheet material such that a distance between the sheet material and the detecting unit opposed to the sheet material is a predetermined value not less than 0, and the image forming means treats the sheet material based on a result of the detection by the information detecting device.

2. An image forming apparatus according to claim 1, wherein said sheet material displacing means protrudes into the sheet material transport path and is adapted to displace the sheet material upon contact with the sheet material.

3. An image forming apparatus according to claim 1, wherein the means for applying an external force comprises an impact applying member for applying an impact to the sheet material upon contact with the sheet material, the sheet material information detecting device further comprising an impact receiving member arranged at a position opposed to the impact applying member and adapted to receive the impact from the impact applying member.

4. An image forming apparatus according to claim 2, wherein the means for applying an external force comprises an impact applying member for applying an impact force to the sheet material upon contact with the sheet material, and wherein said sheet material displacing means is arranged at a position opposed to the impact applying member and is an impact receiving member adapted to receive the impact from the impact applying member.

5. An image forming apparatus according to claim 3, wherein the detecting unit supports the impact receiving member and detects an impact received by the impact receiving member.

6. An image forming apparatus according to claim 3, wherein the detecting unit is mounted on a side of the impact applying unit and detects a force impact through the applying means for applying an external force.

7. An image forming apparatus according to claim 4, wherein the sheet material displacing means determines at least one of a position of the sheet material with respect to the detecting unit, a position of the sheet material with respect to the impact applying member, and a position of the sheet material with respect to the impact receiving member.

8. An image forming apparatus according to claim 7, wherein the sheet material displacing means brings the sheet material into contact with the impact receiving member.

9. An image forming apparatus according to claim 2, further comprising an auxiliary displacing member on a side opposed to the sheet material displacing means with interposition of the sheet material therebetween, wherein the auxiliary displacing member brings the sheet material into contact with the sheet material displacing means.

10. An image forming apparatus according to claim 1, wherein the sheet material displacing means further comprises a sheet material sensor for detecting a state and position of the sheet material.

11. An image forming apparatus as claimed in claim 1, and a sheet material processing portion for performing processing of the sheet material based on a detection result obtained by the sheet material information detecting device.

* * * * *